US005596809A

United States Patent [19]

Beard

[11] Patent Number: 5,596,809

[45] Date of Patent: Jan. 28, 1997

[54] CIRCLE CUTTER FOR DRYWALL WITH MEASURE GUIDE

[76] Inventor: Jay T. Beard, 413 E. Poplar Ave., San Mateo, Calif. 94401

[21] Appl. No.: 567,188

[22] Filed: Dec. 27, 1995

[51] Int. Cl.[6] ..... B43L 9/04

[52] U.S. Cl. ..... 30/310; 33/27.031

[58] Field of Search ..... 30/300, 310; 33/27.01, 33/27.02, 27.03, 27.031, 27.032, 27.033; 83/745

[56] References Cited

U.S. PATENT DOCUMENTS

| | | | |
|---|---|---|---|
| 47,421 | 4/1865 | Hubner | 30/310 |
| 376,974 | 1/1888 | Wunderlich . | |
| 816,733 | 4/1906 | McDonald . | |
| 1,308,650 | 7/1919 | Wilson . | |
| 2,106,398 | 1/1938 | Bartusch | 33/27.03 |
| 2,134,069 | 10/1938 | Zimmerman . | |
| 2,194,409 | 3/1940 | Stangohr . | |
| 2,269,510 | 1/1942 | Bates . | |
| 2,735,486 | 2/1956 | Millard . | |
| 2,943,392 | 7/1960 | Attridge | 30/361 |
| 3,286,351 | 11/1966 | McAlister | 33/42 |
| 3,430,347 | 3/1969 | Minniear | 33/27 |
| 4,044,464 | 8/1977 | Schiess et al. | 30/164.9 |
| 4,782,730 | 11/1988 | Picone et al. | 83/745 |
| 4,858,322 | 8/1989 | Kluga | 30/310 |
| 5,065,517 | 11/1991 | Markes | 30/300 |
| 5,233,748 | 8/1993 | Logan et al. | 30/310 |
| 5,235,754 | 8/1993 | Sirois | 33/27.03 |
| 5,349,760 | 9/1994 | DeVito | 33/760 |

*Primary Examiner*—Hwei-Siu Payer
*Attorney, Agent, or Firm*—Law Office of Albert J. Dalhuisen

[57] ABSTRACT

The present invention provides for circle cutters to cut drywall. The circle cutters include a removable pivoting member, a beam and a cutting member. The beam has a groove with teeth in the bottom as well as a slot. The pivoting member includes a surface having teeth for interlocking with the groove teeth. Additionally, one or more contact protrusions can be provided on the bottom surface of the beam for improved circle cutting on textured drywall surfaces.

18 Claims, 4 Drawing Sheets

CIRCLE CUTTER FOR DRYWALL WITH MEASURE GUIDE

FIELD OF THE INVENTION

The present invention to cutting devices for cutting sheet materials. More particularly, the invention relates to hand held circle cutting devices for cutting rigid sheet materials such as drywall and the like.

BACKGROUND OF THE INVENTION

Sheet materials such as drywall are commonly used for wall cladding in the construction of buildings and houses. These sheet materials are usually supplied in selected sizes, such as 4 feet × 8 feet. When installing these sheets it is often necessary to cut a circle, and remove the disk which is thus formed, to install a fixture, such as, an inset lighting fixture. Similarly, it is sometimes necessary to cut a circular hole in drywall which has already been installed.

A variety of tools is commonly used to cut circular holes in drywall. For example, hand tools, such as, chisels and keyhole saws are used for this purpose. Power tools, such as, drill-powered hole saws and sabre saws are also utilized to cut circular holes in drywall. The above tools have well known disadvantages. For example, while a power hole saw usually cuts a neat circle, it generates a considerable amount of gypsum dust which is generally bothersome to persons who are near the hole cutting site. Also, the large diameter holes saws which am needed for large circular holes generate torque during the use of the hole saw which makes it a difficult and somewhat hazardous operation for the user of the tool. Sabre saws also generate a considerable amount of gypsum dust and these tools have the additional disadvantage that the edges of the circular holes are rather jagged which may require an additional finishing operation.

The above mentioned hand tools require more time for cutting a circular hole than power tools and they generally do not result in neat cuts thus often requiring an additional finishing operation. Also, it is difficult to make an accurate circular hole using these hand tools.

Circular cutters for such diverse sheet materials as paper, cork, rubber and glass are well known. Typically, these cutters include (1) a cutting member for cutting or scribing the sheet material, (2) a pivoting member for temporarily affixing the cutter to the center of the circle and (3) a beam or arm connecting the cutting member and the pivoting member. Generally, a marked distance scale is provided on the beam. These types of cutters are commonly known as circle cutters, circle scribers, curved line scribers and beam compasses.

For example, U.S. Pat. Nos. 5,235,754 (Sirois, 1993), 5,065,517 (Markes, 1991) and 2,943,392 (Attridge, 1960) disclose beam compass types of circle cutters each having a cutting member, a pivoting member and a beam. However, these circle cutters do not provide an optimal design for cutting drywall because the performance of these tools is likely to be adversely affected by gypsum dust.

For example, the '754 patent teaches a compass holder which slides on a beam. Gypsum dust caking on the compass holder may interfere with the sliding movement of the compass holder thus resulting in either inaccurate circle cuts or in down-time which is necessary to clean the tool. The '517 patent teaches a cutting block which is slideably received by a slot and is held in position by a thumbscrew, or in another embodiment by a spring-biased detent ball. The slideable positioning of the thumbscrew and the spring-biased detent ball are likely to be adversely affected by gypsum dust. The '392 patent teaches a pivot assembly which is slideably received in exposed slots in the beam thus resulting in a tool which does not have an optimal design for use in a gypsum dust environment.

Gypsum dust is usually present wherever drywall is being installed or cut. Gypsum dust is known to cake on hard surfaces. This dust is abrasive and is likely to ultimately wear down surfaces which make a sliding or a screw contact.

Accordingly, the need exists for a drywall circle cutter having improved ease of use while being less affected by abrasive dust than currently known circle cutters.

SUMMARY OF THE INVENTION

The present inventions provides novel circle cutters for drywall.

In one embodiment the current invention provides circle cutters including a cutting member, a beam comprising a groove having a slot and teeth, and a removable pivoting member having a surface with teeth for interlocking with the groove teeth.

In another embodiment the present invention provides circle cutters including a cutting member comprising a knife blade which is held in a cutting position by means of a removable beam portion, a beam comprising a groove having a slot and teeth, and a removable pivoting member having a surface with teeth for interlocking with the teeth which are positioned at the bottom of the groove.

In yet another embodiment the current invention provides circle cutters including a cutting member, a beam comprising a groove having a slot and teeth, wherein the beam has a bottom surface which is provided with one or more contact protrusions, and a removable pivoting member having a surface with teeth for interlocking with the teeth at the bottom of the groove.

DETAILED DESCRIPTION OF THE INVENTION

Figure 1:
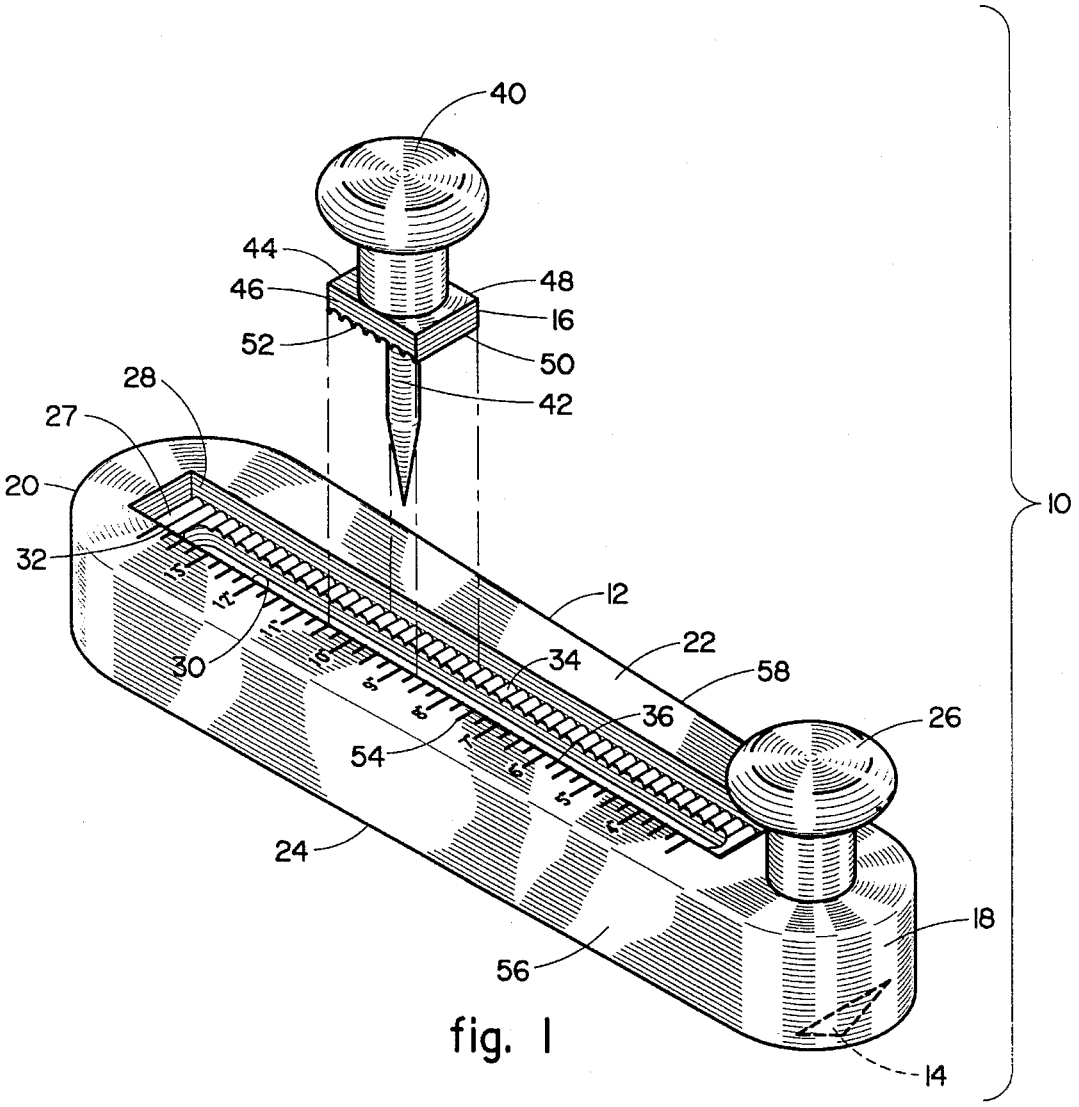
FIG. 1 is an exploded schematic perspective view illustrating a circle cutter of the present invention.
Figure 2:
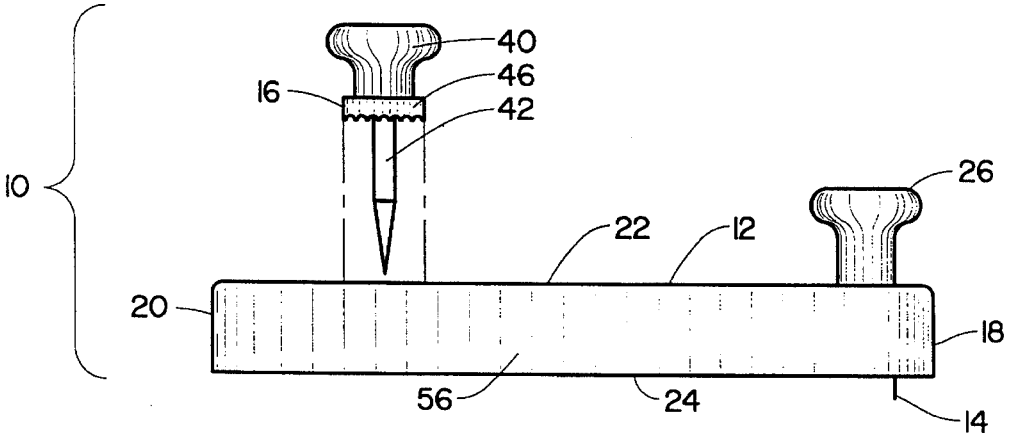
FIG. 2 is an exploded schematic side elevation view of the circle cutter illustrated in FIG. 1.

While describing the invention and its embodiments, certain terminology will be utilized for the sake of clarity. It is intended that such terminology include not only the recited embodiments but all equivalents which perform substantially the same function, in substantially the same manner to achieve substantially the same result.

It will be understood that the term drywall as defined herein includes rigid sheet materials consisting of a core of gypsum or plaster of Paris which is sandwiched between layers of paper. These sheet materials are also known as plasterboard, wallboard, gypsum board, rock lath and sheetrock.

The present invention utilizes knife blades such as the conventional replaceable knife blades, these are well known to those skilled in the art. Typically, these blades have a cutting edge along one edge of the blade which ends in a sharp tip. An example of a knife blade suitable for use with embodiments of the present invention is a parallelogram shaped blade having sides of about ⅜ inch and about ¾ inch wherein the ⅜ inch side is sharpened for cutting. Another example of a suitable knife blade is a trapezoid blade having parallel sides of about ⅝ inch and about 1⅛ inch wherein the 1⅛ side is sharpened.

One embodiment of the present invention is illustrated in FIGS. 1 through 4, showing a circle cutter 10, including a beam 12, a cutting member such as a knife blade, having a cutting end 14 which extends from beam 12, and a pivoting member 16. Beam 12 has a first end 18 and a second end 20. Beam 12 has a top surface 22 which surface faces the user when utilizing circle cutter 10. Beam bottom surface 24 opposes top surface 22 and is substantially parallel thereto. Beam bottom surface 24 faces the workpiece when utilizing this tool. A longitudinal axis is positioned centrally in the beam, parallel to beam top surface 22. A handle 26 is mounted to beam top surface 22 proximate first end 18. Knife cutting end 14 extends from bottom surface 24 proximate first end 18. The knife blade is positioned in a plane which is substantially perpendicular to the longitudinal axis.

Beam 12 has a groove 27 in top surface 22 between first end 18 and second end 20. Groove 27 is positioned substantially parallel to the longitudinal axis. Groove 27 has groove sides 28 and 30 which are smooth and which are approximately parallel to each other. Groove 27 has bottom (referred to as a groove bottom) 32 which includes teeth (referred to as groove teeth) 34 and a slot (referred to as a groove slot) 36. Groove slot 36 is provided substantially along the entire length of groove 27 and extends from groove bottom 32 to beam bottom surface 24. Preferably, groove slot 36 is positioned centrally along the groove bottom.

Teeth 34 are spaced substantially equidistant from each other in the groove bottom. Teeth 34 positioned at groove bottom 32 extend around groove slot 36. Preferably, the distance between two adjacent teeth ranges from about 1/32 inch to about 1/16 inch. The shape of the teeth is not critical for the present invention. For example, the teeth can have a conventional triangular cross sectional shape or a rectangular cross sectional shape. However, the teeth shape and dimensions should be substantially uniform across the entire groove bottom.

Pivoting member 16 includes a pivoting handle 40, a bit 42 and a beam fitting member 44 between handle 40 and bit 42. Bit 42 is substantially coaxial with handle 40 and is preferably at least about ⅝ inch long. Beam fitting member 44 has sides 46 and 48. The diameter of the bit shaft is substantially smaller than the width of groove slot 36 while the distance between sides 46 and 48 of the beam fitting member is substantially smaller than the width of groove 27 between groove sides 28 and 30. Beam fitting member 44 has a beam fitting surface 50 for contacting the groove bottom. Beam fitting surface 50 faces bit 42 and is perpendicular thereto. Beam fitting surface 50 is provided with beam fitting teeth 52, wherein these teeth are shaped to interlock with groove bottom teeth 34 when the beam fitting member is brought into contact with the groove bottom by inserting pivoting member 16 into groove 27. Pivoting member 16 is adapted for locking onto beam 12 by means of the matching teeth 34 and 52 and by the user's hand exerting a downward pressure on handle.

Figure 3:
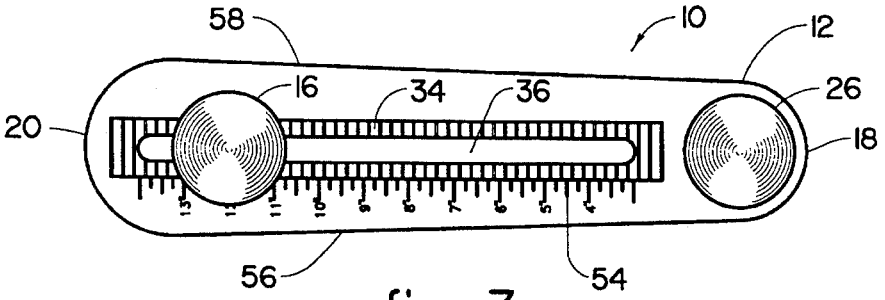
FIG. 3 is a schematic plan view of the circle cutter illustrated in FIG. 1.

Optionally, a distance scale or measure guide 54 is provided on top surface 22 of beam 12 to indicate the distance between bit 42 and cutting end 14 of the knife blade. As shown in FIG. 3, sides 56 and 58 of beam 12 are tapered towards end 18. The tapered sides are a preferred feature of the present invention but it is not a critical feature, for example, the sides of the beam can be such that they are parallel to each other.

Figure 4:
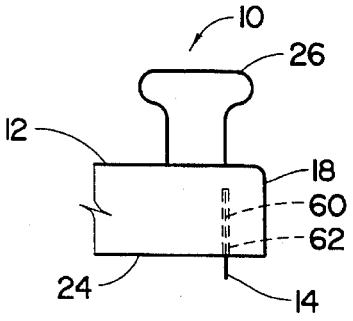
FIG. 4 is a schematic side elevation view of a detail of the circle cutter illustrated in FIG. 1.

FIG. 4 shows the placement of knife blade 60 of circle cutter 10 having cutting end 14, wherein the knife is retained in a knife slot 62 which extends from beam bottom surface 24 into the beam. Knife slot 62 is positioned substantially perpendicular to the longitudinal axis. During the use of the circle cutter, knife blade 60 remains in position in knife slot 62 because of the downward pressure exerted by the user on handle 26 while making a circle cut. Preferably, the knife slot conforms to the shape of the knife such that the cutting end extends a predetermined length from the bottom surface thus providing an exposed cutting tip.

Figure 5:
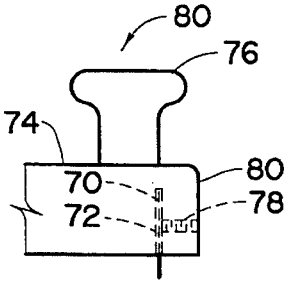
FIG. 5 is a schematic side elevation view of a detail of an alternate circle cutter of the present invention.
Figure 6:
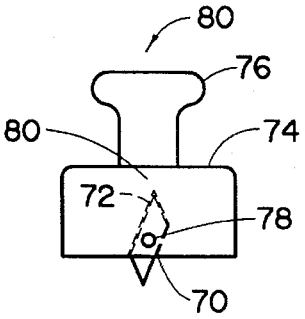
FIG. 6 is a schematic front elevation view of the detail of the alternate circle cutter illustrated in FIG. 5.

Alternately, the knife blade can be locked in place as illustrated in FIGS. 5 and 6 showing circle cutter 80 and depicting a knife blade 70 retained in a knife slot 72 in circle cutter beam 74 having a handle 76. In this embodiment of the present invention a fastening means such as a fastening screw or bolt 78 is threadably engaged in beam 74 such that fastening screw 78 extends from the beam first end 80 into knife slot 72.

Figure 7:
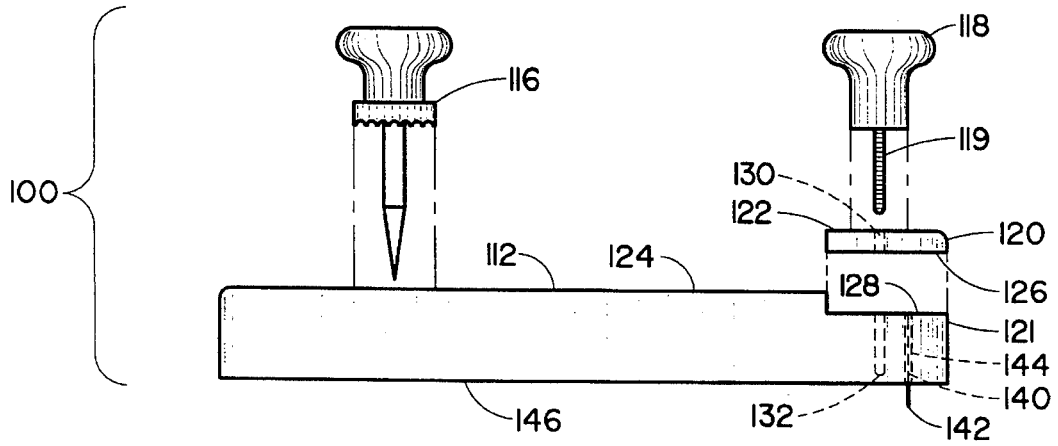
FIG. 7 is an exploded schematic side elevation view of an additional circle cutter of the present invention.
Figure 8:
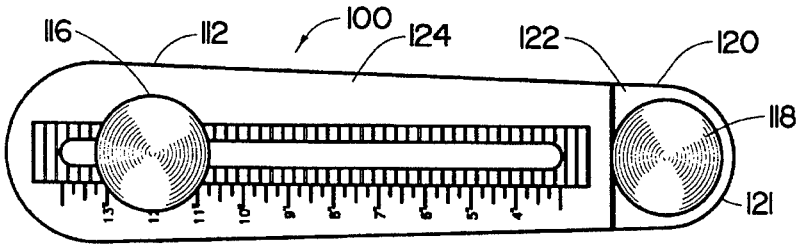
FIG. 8 is a schematic plan view of the circle cutter illustrated in FIG. 7.
Figure 9:
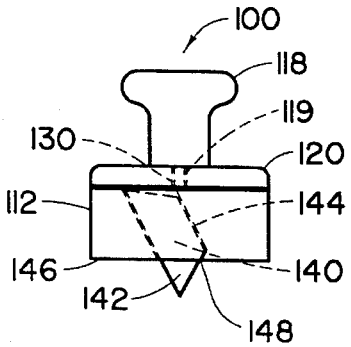
FIG. 9 is a schematic front elevation view of the circular cutter illustrated in FIG. 7.

FIGS. 7, 8 and 9 illustrate circle cutter 100 which is and alternate embodiment of the current invention. Circle cutter 100 includes a pivoting member 116 which is similar to pivoting member 16 of circle cutter 10 (FIG. 1). Beam 112 of cutting device 100 has a groove. This groove has a bottom (referred to as the groove bottom) having teeth (referred to as the groove teeth) and a slot (referred to as the groove slot)similar to beam 12 of cutting device 10. Beam handle 118 of circle cutter 100 is provided with a threaded shaft 119, wherein the threaded shaft 119 extends substantially coaxial from beam handle 118.

A removable beam portion 120 (FIGS. 7, 8 and 9) extends from beam first end 121 to a region proximate the groove, without extending into the groove. First surface 122 of portion 120 is substantially co-planar with top surface 124 of beam 112. Second surface 126 of portion 120 contacts beam 112. Second surface 126 of portion 120 contacts beam 112 at beam surface section 128 when portion 120 is placed in contact with the beam. Portion 120 includes a through-hole 130, wherein the diameter of through-hole 130 exceeds the diameter of shaft 119. A threaded hole 132 is provided in the beam for threadably receiving shaft 119.

A knife blade 140, having an exposed cutting end 142, is positioned in a knife slot 144 as shown in FIG. 9. Slot 144 is shaped to conform to the shape of knife blade 140 such that a cutting end 142 protrudes a predetermined length from bottom surface 146. As shown in FIG. 9, slot 144 is not wide enough at bottom surface 146 to allow the knife to fall or slide out of slot 144. The width of knife blade 140 between its parallel edges exceeds the width of slot 144 at point 148, i.e. the width of the slot at bottom surface 146. Knife blade 140 is held in place in slot 144 by portion 120. Beam handle 118 affixes portion 120 to beam 112 when shaft 119, passing through through-hole 130, is threaded into matching threaded hole 132.

Figure 10:
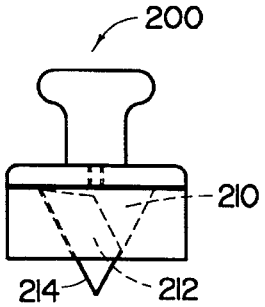
FIG. 10 is a schematic front elevation view of an alternate circle cutter of the present invention.
Figure 11:
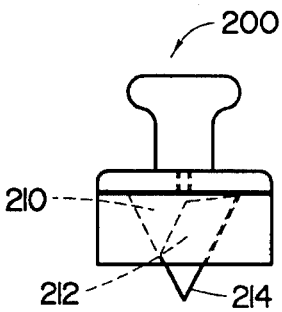
FIG. 11 is a schematic front elevation view of the circle cutter illustrated in FIG. 10, showing a different position of the knife blade.

FIGS. 10 and 11 depict a detail of an additional circle cutter 200 which is similar to circle cutter 100 (FIG. 7) except that circle cutter 200 employs a knife slot 210 which is configured to accept knife blade 212 such that the knife blade can be inserted and utilized for either clockwise or counter-clockwise cutter motion. This is accomplished by reversing the position of cutting edge 214 in knife slot 210 and making the cut in the direction in which the knife cutting edge is the leading edge of the cutting end.

Figure 12:
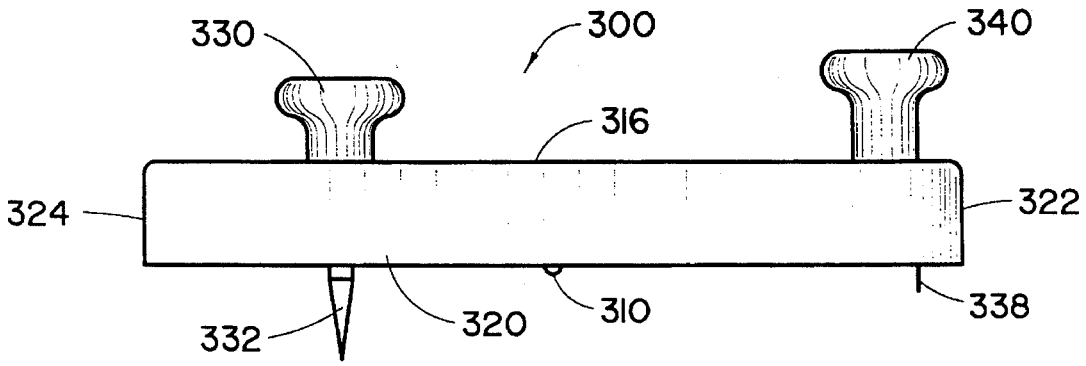
FIG. 12 is a schematic side elevation view of an additional circle cutter of the present invention.
Figure 13:
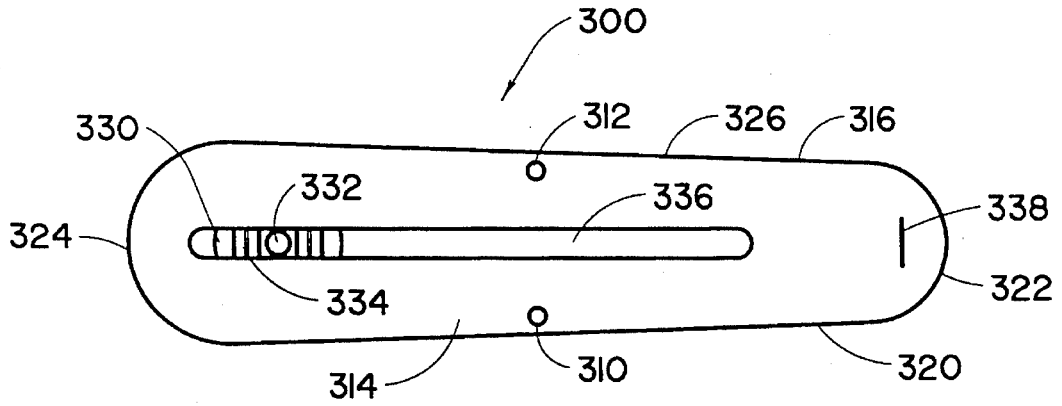
FIG. 13 is a schematic bottom view of the circle cutter illustrated in FIG. 12.

Circle cutter 300 (FIGS. 12 and 13) illustrates an alternate embodiment of the present invention. Circle cutter 300 is similar to circle cutter 10 (FIG. 1) except that circle cutter 300 is equipped with contact protrusions 310 and 312 projecting from bottom surface 314 of beam 316. These contact protrusions contact the surface of the workpiece, such as drywall, when the circle cutter is used to cut a circular hole. Each protrusion has a smooth, preferably rounded surface. The distance between the tip of the protrusion and bottom surface 314 ranges from about 1/32 inch to about 1/8 inch, preferably this distance is about 1/16 inch.

Protrusion 310 is positioned on bottom surface 314 proximate side 320 of beam 316, approximately equidistant between beam first end 322 and beam second end 324. Protrusion 312 is similarly positioned proximate side 326. Circle cutter 300 includes a pivoting handle 330, a bit 332, beam fitting teeth 334, a groove slot 336, a knife blade 338 and a beam handle 340.

While circle cutter 300 shows a preferred embodiment having two contact protrusions, other embodiments include having a total of one or more contact protrusions positioned on the beam bottom surface between the first end and the second end of the beam. Similarly, circle cutters, such as cutting devices 100 and 200 (FIG. 7 through 11 ) can be equipped with one or more contact protrusions.

Circle cuts are made in drywall and like materials, with circle cutters of the present invention using the following methods. For example, a circle is cut and the circle section is removed from drywall using circle cutter 10 (FIG. 10). Pivoting member 16 is removed from cutting device 10 and the tip of bit 42 is placed in the center of the circle. The bit is then punched through the sheet, preferably making a through-hole through the sheet. Usually, hand pressure on the pivoting member has sufficient force to punch the bit through the sheet. However when the drywall has received a plaster coating or other hardened coating, it may be necessary to drive the punch through the sheet using an impact tool such as a hammer. It will be understood that pivoting member 16 is thereby used as an awl.

The pivoting member 16 is then removed from the drywall and the bit is inserted in groove slot 36. Beam fitting teeth 52 are brought into interlocking contact with groove teeth 34 such that the distance between bit 42 and knife blade cutting end 14 is substantially equal to the radius of the circle which needs to be cut. Bit 42 is inserted in the punched hole. Hand pressure is exerted on pivoting handle 40 while beam handle 26 is grasped and manipulated to rotate beam 12 around the pivoting member one full turn. The cutter is removed, the bit is placed in the punched through-hole on the opposite side of the drywall sheet and the circle cut is repeated. After removal of the circle cutter, the cut circle can be separated from the sheet by exerting moderate hand pressure.

When the circle needs to be cut from installed drywall it is usually not possible to cut a circle on both sides of the sheet. In that case, a circle cut is made in the exposed drywall surface as described above. The circle cutter is detached from the drywall surface and the circle is separated from the drywall by hand pressure against it or by tapping the cut circle lightly with a hammer.

In the above description of the curing methods, the pivoting member was removed from the circle cutter in order to punch a through hole. However, it has been found that it is also possible to punch a hole in drywall without removing the pivoting member from the circle cutter, provided the drywall does not have a hardened coating.

The easy removability of the pivoting member is a distinct advantage when a hammer is required to punch a hole with the pivoting member, such as when the drywall has a hardened coating. In that case, removal of the pivoting member protects the other components of the beam cutter from impact damage.

While making circle cuts using circle cutters of the present invention, such as cutting devices 10 and 100, it is preferred that the bottom surface of the beam slideably touches the surface of the drywall when the beam is rotated around the pivoting member. Contact between the bottom surface and the drywall maximizes the stability of the beam during cutting. However, the sliding contact is seriously impeded when the drywall has a textured surface such as a plaster coating, textured paint coating or textured wallpaper. The contact protrusions utilized on cutting devices such as circle cutter 300 (FIGS. 12 and 13) result in a surprising improvement in the sliding contact movement between the rotating beam and the textured drywall surface. Circle cutters having a wheel attached to the beam or cutting member are known to those skilled in the art. The use of rotating wheels however is not an optimal design for use on circle cutters for drywall since these moving components are likely to be affected by gypsum dust, and because wheels generally require a greater distance between the bottom of the beam and the drywall surface than is required by the contact protrusions employed in the present invention.

The devices of the present invention do not utilize a pivoting member or a cutting member which makes slideable contact with a beam or which requires the positioning of these members by means of a screw fastener. As a result the cutting devices of the present invention are less affected by abrasive dust such as gypsum dust than typical prior art circle cutters. While it is possible for dust to settle and cake in between the teeth, this generally does not affect the use of the cutter since any dust which is present on the teeth is merely squeezed between the teeth contacting surfaces without affecting the accuracy of the circle cut and without requiring clean-up time. Knife blades used in the embodiments of this invention may require screw fasteners but these are fasteners which are used when a knife blade is replaced, not when the distance between the pivoting member and the cutting member is adjusted to obtain the required circle size.

It is noted that the distance between the bit and the cutting end of the knife blade is not infinitely variable since the placement of the pivoting member depends on interlocking the teeth. The distance is thus variable only by increments which equal the distance between two adjacent teeth. This however, is not a practical disadvantage if the distance between two adjacent teeth ranges from 1/32 inch to about 1/16 inch since this usually provides sufficient precision for drywall circular holes.

The circle cutters of the present invention generally enable even an unskilled user to obtain drywall circle cuts of a predetermined diameter without the use of power tools thus generating very little dust while not requiring any more time than is usually needed to make a circle cut with a power tool. Additionally, cuts made with the circle cutters of the current invention generally result in holes having a relatively smooth edge thus not requiring a secondary finishing operation.

Unexpectedly, the present cutters offer the advantage of providing a combination tool, i.e. a circle cutter when the pivoting member is placed in the beam and an awl when the pivoting member is removed from the beam and used separately. Thus the user of the circle cutter does not need a separate awl if this is needed to punch holes unrelated to the cutting of circles, such as, for example punching holes in wood to start a nail or a drill bit.

The invention has been described in terms of the preferred embodiments. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims.

I claim:

1. A device for cutting drywall comprising:

a) a knife blade having predetermined dimensions and having a cutting end;

b) a beam comprising: (1) a first end, (2) a second end opposing the first end, (3) a longitudinal axis positioned centrally in the beam, (4) a beam top surface, (5) a beam bottom surface opposing the beam top surface, (6) a beam first side, (7) a beam second side, (8) a first region along the top surface defining a groove which is substantially parallel to the longitudinal axis wherein the groove has a groove bottom comprising: (i) groove teeth which are spaced substantially equidistant from each other and (ii) a second region defining a groove slot, which is substantially parallel to the longitudinal axis, extending through the beam to the beam bottom surface and (9) a beam handle having a threaded shaft extending substantially coaxial from the beam handle, (10) a removable beam portion extending from the first end to a region proximate the groove wherein the removable beam portion comprises: (i) a first surface which is substantially co-planar with the beam top surface when the removable portion contacts the beam, (ii) a second surface which is substantially parallel with the first surface wherein the second surface is adapted for contacting the beam, (iii) a first area defining a through-hole extending from the first surface to the second surface for receiving the beam handle threaded shaft and (11) a second area defining a threaded hole for threadably receiving the beam handle threaded shaft;

c) a pivoting member comprising: (1) a pivoting handle, (2) a bit which is substantially coaxial with the pivoting handle and (3) a beam fitting member intermediate the pivoting handle and the bit wherein the beam fitting member is shaped to fit inside the groove and wherein the beam fitting member has a beam fitting surface for contacting the groove bottom in which the beam fitting surface comprises beam fitting teeth which are shaped to interlock with the groove teeth when the beam fitting surface is brought into contact with the groove bottom; and d) a third region defining a knife slot in the beam bottom surface for retaining the knife blade wherein the knife slot is positioned along a plane which is substantially perpendicular to the longitudinal axis and which is proximate the first end.

2. The cutting device according to claim 1 wherein the knife slot conforms substantially to the shape of the knife blade such that the cutting end protrudes a predetermined length from the bottom surface.

3. The cutting device according to claim 1 additionally comprising a knife blade fastening means for fastening the knife blade in the knife slot.

4. The cutting device according to claim 3 wherein the knife blade fastening means comprises a fastening screw which is threadably engaged in the beam such that the fastening screw extends from the first end into the knife slot.

5. The cutting device according to claim 1 additionally comprising one or more contact protrusions projecting from the beam bottom surface.

6. The cutting device according to claim 1 additionally comprising: (1) a first contact protrusion projecting from the beam bottom surface and (2) a second contact protrusion projecting from the beam bottom surface.

7. The cutting device according to claim 6 wherein the first contact protrusion is positioned proximate the beam first side substantially equidistant from the first end and the second end, and wherein the second contact protrusion is positioned proximate the beam second side substantially equidistant from the second end and the first end.

8. The cutting device according to claim 1 additionally comprising a distance scale provided on the beam top surface proximate the groove.

9. The cutting device according to claim 1 wherein the beam first side and the second side taper toward the first end.

10. A device for cutting drywall comprising:

a) a knife blade having predetermined dimensions and having a cutting end;

b) a beam comprising: (1) a first end, (2) a second end opposing the first end, (3) a longitudinal axis positioned centrally in the beam, (4) a beam top surface, (5) a beam bottom surface opposing the beam top surface, (6) a beam first side, (7) a beam second side, (8) a first region along the top surface defining a groove which is substantially parallel to the longitudinal axis wherein the groove has a groove bottom comprising: (i) groove teeth which are spaced substantially equidistant from each other and (ii) a second region defining a groove slot, which is substantially parallel to the longitudinal axis, extending through the beam to the beam bottom surface and (9) a beam handle mounted on the beam top surface proximate the first end;

c) a pivoting member comprising: (1) a pivoting handle, (2) a bit which is substantially coaxial with the pivoting handle and (3) a beam fitting member intermediate the pivoting handle and the bit wherein the beam fitting member is shaped to fit inside the groove and wherein the beam fitting member has a beam fitting surface for contacting the groove bottom in which the beam fitting surface comprises beam fitting teeth which are shaped to interlock with the groove teeth when the beam fitting surface is brought into contact with the groove bottom; and d) a third region defining a knife slot in the beam bottom surface for retaining the knife blade wherein the knife slot is positioned along a plane which is substantially perpendicular to the longitudinal axis and which is proximate the first end.

11. The cutting device according to claim 10 wherein the knife slot conforms substantially to the shape of the knife blade such that the cutting end protrudes a predetermined length from the bottom surface.

12. The cutting device according to claim 10 additionally comprising a knife blade fastening means for fastening the knife blade in the knife slot.

13. The cutting device according to claim 12 wherein the knife blade fastening means comprises a fastening screw which is threadably engaged in the beam such that the fastening screw extends from the first end into the knife slot.

14. The cutting device according to claim 10 additionally comprising one or more contact protrusions projecting from the beam bottom surface.

15. The cutting device according to claim 10 additionally comprising: (1) a first contact protrusion projecting from the beam bottom surface and (2) a second contact protrusion projecting from the beam bottom surface.

16. The cutting device according to claim 15 wherein the first contact protrusion is positioned proximate the beam first side substantially equidistant from the first end and the second end, and wherein the second contact protrusion is positioned proximate the beam second side substantially equidistant from the second end and the first end.

17. The cutting device according to claim 10 additionally comprising a distance scale provided on the beam top surface proximate the groove.

18. The cutting device according to claim 10 wherein the beam first side and the second side taper toward the first end.

* * * * *